US005692276A

United States Patent [19]

Paxton

[11] Patent Number: 5,692,276

[45] Date of Patent: Dec. 2, 1997

[54] FOOTWEAR FASTENERS

[76] Inventor: Bradley Joseph Paxton, 72 Gondola Road., North Narrabeen, New South Wales 2101, Australia

[21] Appl. No.: 587,037

[22] Filed: Jan. 16, 1996

Related U.S. Application Data

[63] Continuation-in-part of Ser. No. 572,965, filed as PCT/AU94/00325, Jun. 15, 1994, abandoned.

[30] Foreign Application Priority Data

Jun. 16, 1993 [AU] Australia ..... PL9434
Jul. 26, 1995 [AU] Australia ..... PN4420

[51] Int. Cl.[6] ..... A43B 11/00; A43C 1/00

[52] U.S. Cl. ..... 24/713.6; 24/697.2; 24/712.1; 24/715.3

[58] Field of Search ..... 24/697.2, 712.1, 24/713.6, 713.9, 714, 715.3, 300; 36/50.1

[56] References Cited

U.S. PATENT DOCUMENTS

| | | | |
|---|---|---|---|
| 0,726,715 | 4/1903 | Long et al. | 24/697.2 |
| 2,049,932 | 8/1936 | Voit et al. | 24/715.3 |
| 2,266,083 | 12/1941 | Rzepa | 24/712.1 |
| 4,790,048 | 12/1988 | Arnt | 24/712.1 |
| 5,111,558 | 5/1992 | Ridley et al. | 24/715.3 |
| 5,353,483 | 10/1994 | Louviere | 24/713.6 |

FOREIGN PATENT DOCUMENTS

| | | |
|---|---|---|
| 1035139 | 3/1939 | Australia . |
| 25403/54 | 5/1954 | Australia . |
| 39104/68 | 3/1970 | Australia . |
| 29147/77 | 4/1979 | Australia . |
| 856780 | 8/1940 | France . |
| 910713 | 6/1946 | France . |
| 883856 | 7/1953 | Germany . |
| 1258569 | 12/1971 | United Kingdom . |
| 2231253 | 11/1990 | United Kingdom . |

*Primary Examiner*—Victor N. Sakran
*Attorney, Agent, or Firm*—Ladas & Parry

[57] ABSTRACT

A footwear fastener for fastening an item of footwear is disclosed. The fastener comprises a two-part clip (102) comprising a first part (104) and a second part (106) for fastening a shoe by interengagement of the two parts (104, 106). Elongate connecting strips (108) are integrally formed at one end to the second part (106) and adjustably attached to the first part (104) passing through two slots (122,124) in rib portions (120) of the first part (104). The connecting strips (108) pass through opposed eyelets (4) in the shoe. The interengagement is achieved by hooking hook-like members (134) over a spine (114) of the second part (106). The fastener is released by lifting of the release member (126).

19 Claims, 7 Drawing Sheets

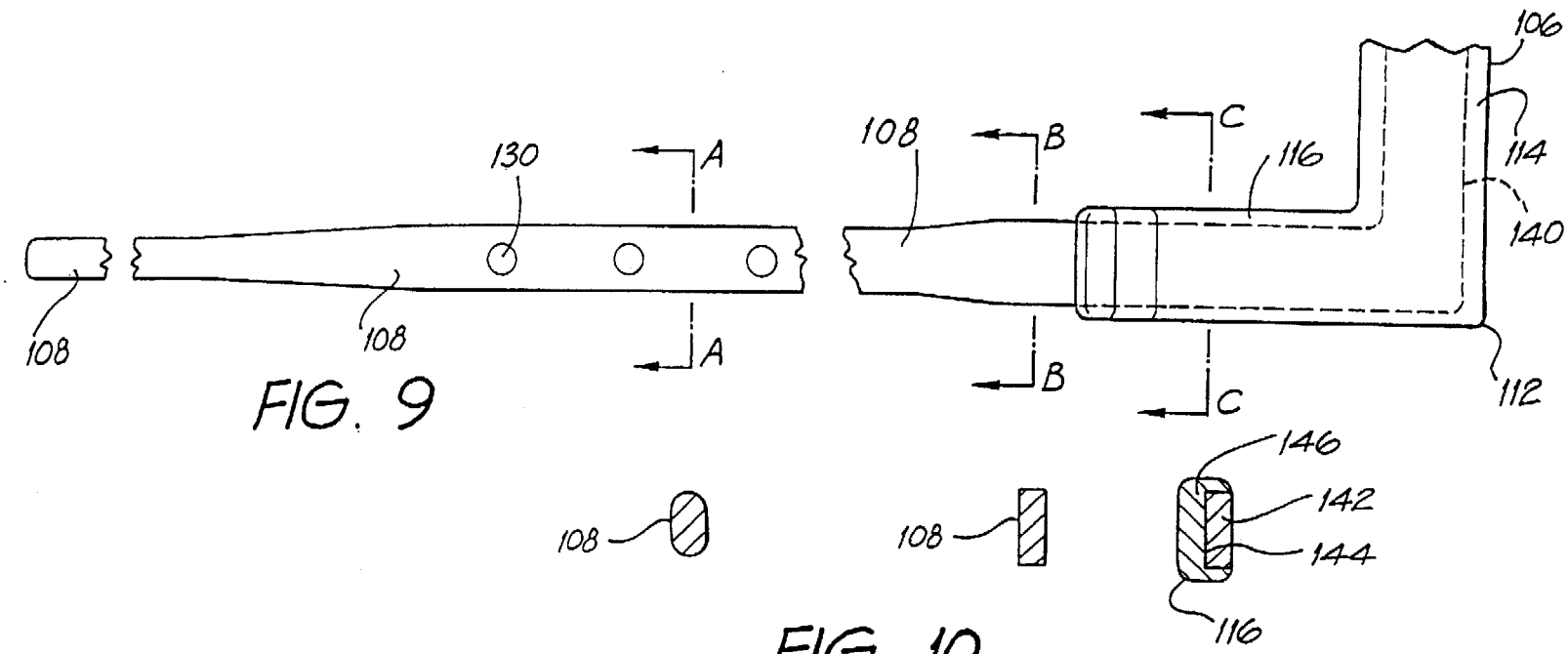
FIG. 9
FIG. 10
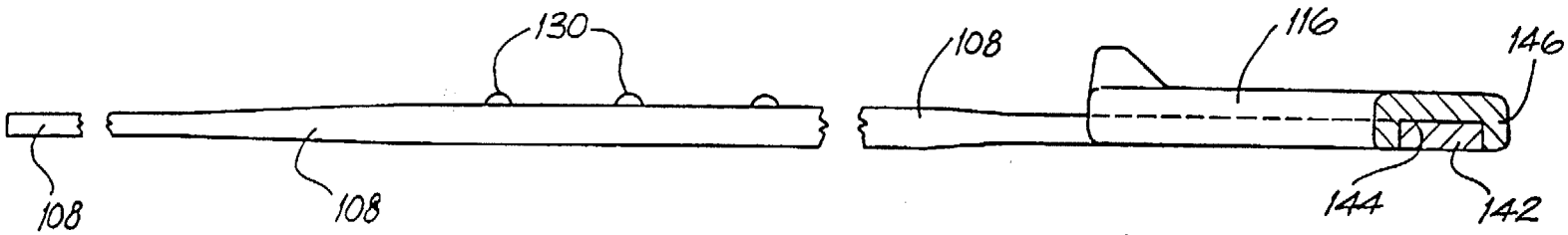
FIG. 11

FOOTWEAR FASTENERS

This application is continuation-in-part of application Ser. No. 08/572,965, filed Dec. 15, 1995, now abandoned; which is a 371 of PCT /AU94/00325, filed Jun. 15, 1994.

FIELD OF THE INVENTION

The invention relates to footwear fasteners.

BACKGROUND OF THE INVENTION

It is known to use clips instead of laces to fasten shoes and other footwear. Such clips can be used with shoes which are designed to be used with laces, and which are thus provided with two rows of eyelets on either side of the shoe opening in conventional fashion. The clip has two parts which can be attached to the eyelets in one way or another, and releasably attached to each other in order to fasten the shoe. This provides a number of advantages over the use of conventional laces. For example, the shoe can be fastened in a single operation by clipping the two parts of the clip together, which is considerably quicker and more convenient than tying laces together. Furthermore, unlike in the case of laces, there is no risk of the clip becoming undone after the shoes have been worn for prolonged periods of time. A further advantage is that, once the clip has been properly adjusted to suit a particular user, the clip ensures that the same tension is applied to the shoe every time the clip is used. In the case of laces, it is often necessary to retie the laces several times in order to achieve the correct amount of tension. This, of course, is time consuming and inconvenient. Moreover, if the footwear is to be used by a professional sports man or woman, it may become a matter of considerable importance that the tension in the shoes can be guaranteed to be correct each time the shoes are worn.

Although such clips provide a number of advantages over conventional laces, they are also prone to some disadvantages. For example, the clips are usually formed from a relatively large number of separate components, thus making them more expensive to manufacture and assemble. Furthermore, known clips can be difficult to release, particularly if the clips are under a fair amount of tension.

Reference also can be had to published Australian Application No. 39104/68 in the name Andrew Kellner that described a prior art footwear fastener.

DISCLOSURE OF THE INVENTION

The invention seeks to provide an improved footwear fastener.

According to one aspect of the present invention there is provided a footwear fastener for fastening an item of footwear having a plurality of eyelets, arranged in spaced opposed pairs in two rows located one to either side of an opening, said fastener comprising an elongate two part clip, the parts of which are releasably interengageable, said clip having a longitudinal extent substantially equal to at least a substantial portion of the length of said row, and a plurality of elongate elastic connecting strips attachable to both parts of the clip in a parallel relationship and at positions corresponding to the spacing of the eyelet pairs, and each said strip being adapted to pass through one of said opposed eyelet pairs, so as to secure said pair of eyelets together when the two parts of the clip are interengaged.

In one preferred form, each elastic connecting strip is integrally formed at one end with one of said parts.

Further preferably, each eyelet has a corresponding strip which is used to connect that eyelet with the corresponding part of the clip.

According to another aspect of the invention there is provided a footwear fastener for fastening an item of footwear having an opening for allowing adjustment of the footwear, and a plurality of eyelets arranged in spaced opposed pairs in two rows located on either side of the opening, the fastener comprising a two-part clip, the two parts of which are interengageable, and at least one elongate connecting strip which is integrally formed with one of said parts and adjustably attachable to the other of said parts, the connecting strip being adapted to pass through one of said opposed eyelet pairs, so as to secure said pair of eyelets together when the two parts of the clip are interengaged.

Preferably, the connecting strip is formed of a material which is more elastic than the material of the part of the two-part clip with which it is integrally formed.

This can be achieved, for example, by using a two-material injection moulding process.

Conveniently, the part of the two-part clip to which the connecting strip is adjustably attached comprises at least one slot adapted to receive, and adjustably secure, a portion of the connecting strip.

The invention also independently provides a footwear fastener for fastening an item of footwear having an opening for allowing adjustment of the footwear, and a plurality of eyelets arranged in spaced opposed pairs in two rows located on either side of the opening, the fastener comprising a two-part clip, the two parts of which are interengageable, and a plurality of elongate connecting strips connected to the two parts of the clip in a parallel relationship and at positions corresponding to the spacing of the eyelet pairs, and each one of said strips being adapted to pass through one of said opposed eyelet pairs so as to secure said eyelets together when the two parts of the clip are interengaged, wherein a first of said parts is provided with at least one hook-like member adapted to hook onto the second of said parts when the first and second parts are interengaged, and the first part is also provided with a release member which projects beyond the hook-like member and which overlies at least a portion of the second part when the two parts are interengaged, and wherein the release member is arranged so that an upward pull on the release member by a user causes the hook-like member to disengage from the second part, thus allowing the first and second parts of the clip to separate.

Conveniently, the release member lies in the same general plane as the first part of the clip. Alternatively, the release member can be upwardly inclined relative to the plane of the first part, for example at an angle of around 45°.

In one embodiment of the invention, the connecting strip is integrally formed with one of said parts and adjustably attached to the other of said parts.

Preferably, the connecting strip is formed from an elastic material.

BRIEF DESCRIPTION OF THE DRAWINGS

Embodiments of the present invention will now be described with reference to the drawings in which:

FIG. 9 is an enlarged view of a portion of the second part of the clip shown in FIG. 1;

FIG. 10 shows three cross-sectional views taken through the portion of the second part of the clip shown in FIG. 10; and FIG. 11 is a side view of the portion of the second part of the clip shown in FIG. 9.

BEST MODE OF CARRYING OUT THE INVENTION

Figure 1:
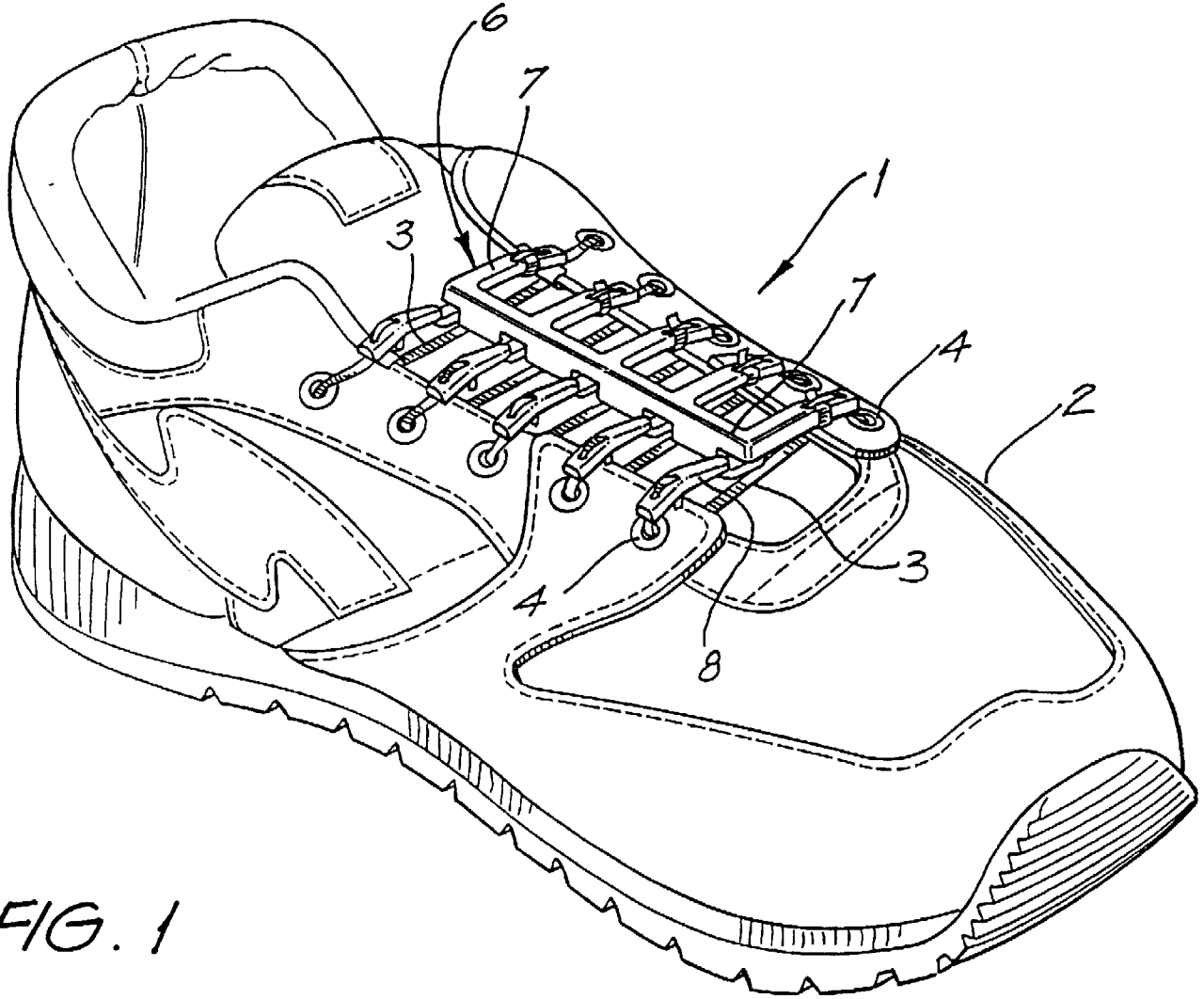
FIG. 1 is a perspective view of a shoe having a footwear fastener of the preferred embodiment with the fastener illustrated when fastened.
Figure 2A:
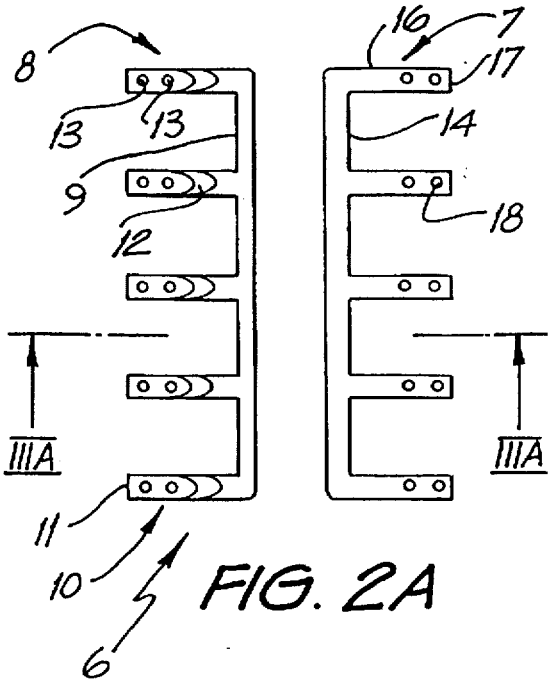
FIG. 2A is a top view of a two-part clip of the fastener of FIG. 1, illustrated when not fastened and without its connecting strips.
Figure 2B:
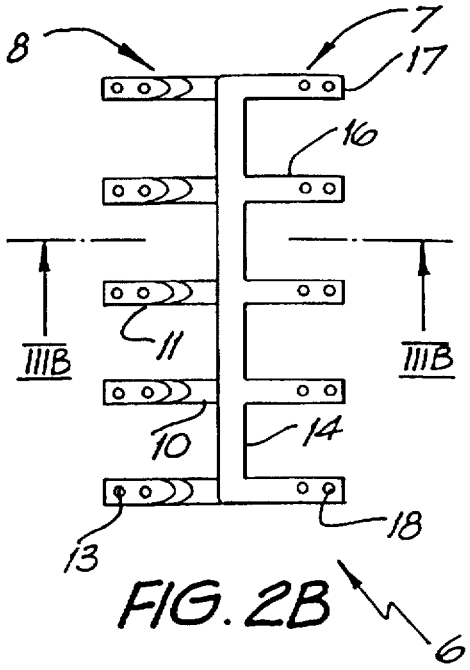
FIG. 2B is a top view of the two-part clip of FIG. 2A illustrated when fastened.
Figure 3A:
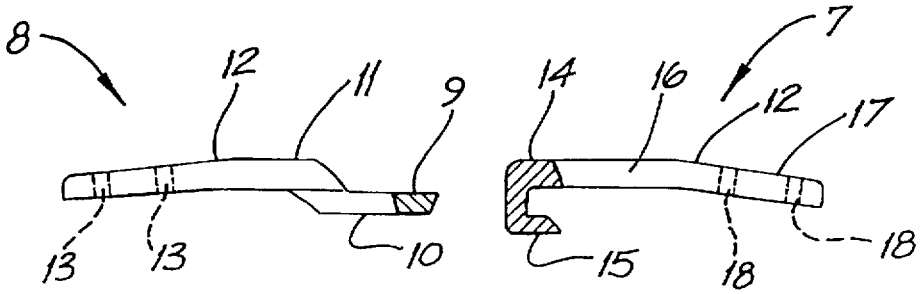
FIG. 3A is a transverse cross sectional view along the line IIIA—IIIA of FIG. 2A.
Figure 3B:
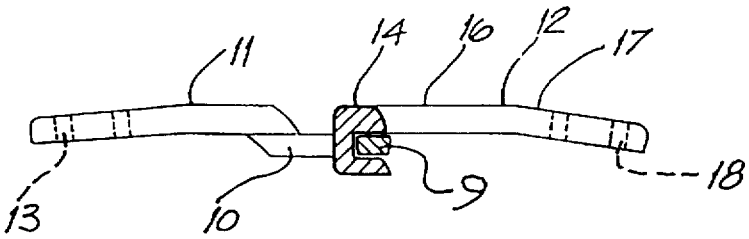
FIG. 3B is a transverse cross sectional view along the line IIIB—IIIB of FIG. 2B.

A footwear fastener 1 of a preferred embodiment is illustrated attached to (an item of footwear) a shoe 2. The shoe fastener 1 takes the form of a number of elongate elastic connecting strips 3 which are fitted through the eyelets 4 of the shoe 2. The connecting strips 3 have ends which are connected to a different one of a two-part clip 6.

The two-part clip 6 includes a top part 7 and a bottom part 8. The bottom part 8 includes a flat bar 9 with five perpendicularly extending limbs 10. Each of the limbs 10 has a lug 11 extending therefrom. The lugs 11 extend in a different plane to that of the bar 9 and limbs 10 and have a slight elbow 12 so that the lugs 11 follow the shape of the shoe 2.

Each of the lugs 11 has a pair of holes 13 to which the end of the connecting strips 3 are able to be threaded.

The top part 7 of the two-part clip 6 includes a flat bar 14 which corresponds to the flat bar 9. Extending downwardly from the bar 14 are four overhanging L-shaped extensions 15 which are each able to clip over the flat bar 9 of the bottom part 8 which results in the bar 14 being on top of the bar 9 when clipped into position. The bar 14 also includes five perpendicularly extending limbs 16 which have a lug 17 on the end thereof. An elbow 12 is also positioned on the lug 17 in a similar manner to the elbow 12 on the lug 11. Each of the lugs 17 have a pair of holes 18 in a similar manner to that of the lugs 11 and the other end of the connecting strips 3 are able to be threaded therethrough.

The lugs 11 and 17 are substantially in the same horizontal plane when the shoe fastener 1 is clipped together, which assists in the aesthetic qualities of the shoe fastener 1.

Figure 4:
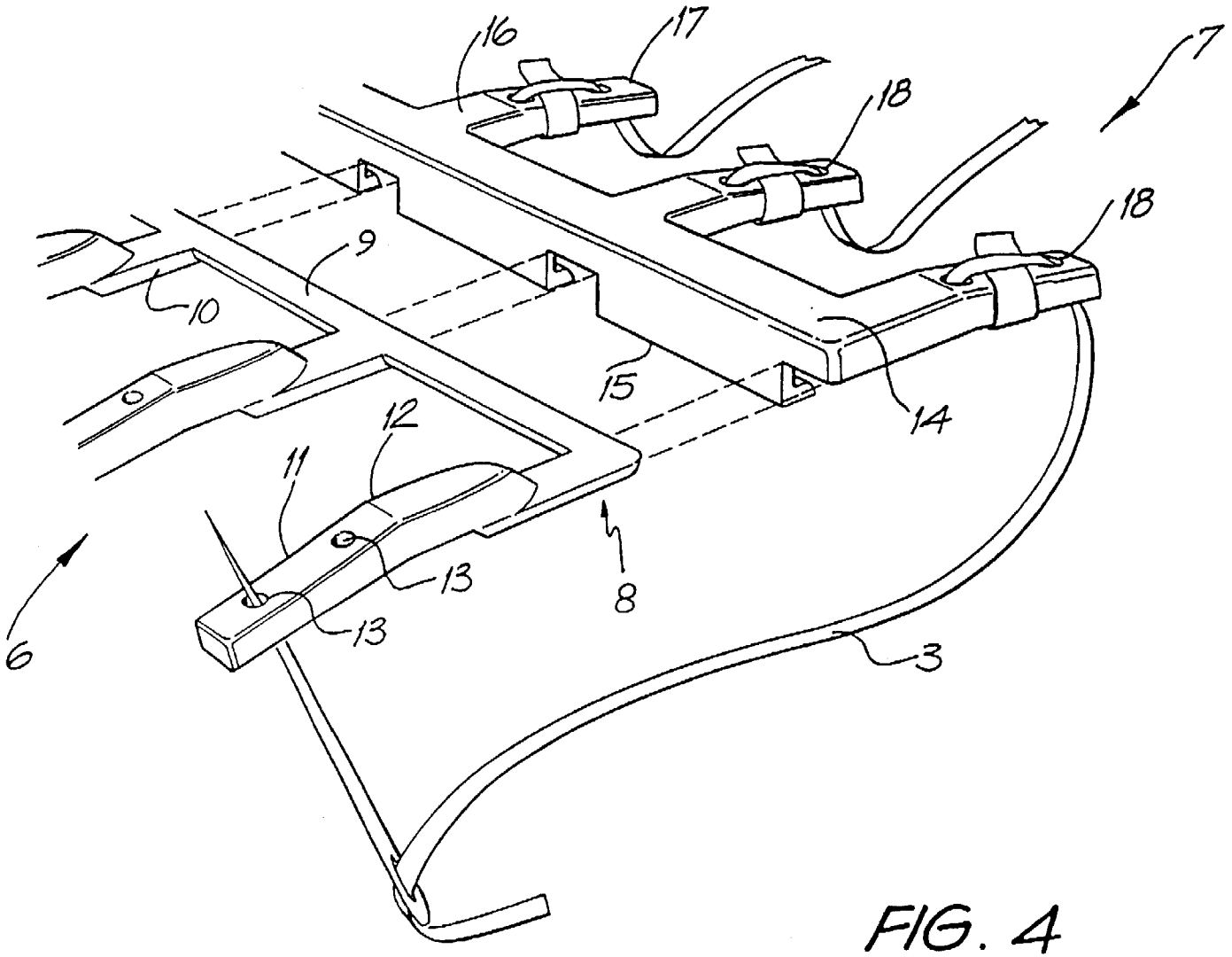
FIG. 4 is a partial perspective view of the fastener illustrated in FIG. 1 illustrating the procedure where a connecting strip is attached to the clip.

The fastener 1 is fitted to the shoe 2 firstly by threading one end of the connecting strip through the holes 18 of the lugs 17. Due to the elasticity and elastomeric nature of the connecting strips 3, once the needs of the strips 3 have been threaded through the holes as illustrated in FIG. 4, the strips are effectively secured thereto. There is no need in this embodiment to more securely connect the connecting strips 3 to the lugs 17. However, it is within the scope of the present invention to have a different method of connection thereto, an example of which is hereafter described.

The other end of the connecting strips 3 are then threaded through the eyelets 4 of the shoe 2 while the two-part clip 6 is clipped together and while the user has his foot within the shoe 2. The other end of each of the connecting strips 3 is then able to be threaded through the holes 13 in the lugs 11. The connecting strips 3 are slightly stretched during the fitting and therefore the elasticity and the elastomeric nature of the material of the connecting strips 3 ensure that the connecting strips 3 remain in place. It is noted that the strips 3 are flat ribbon like strips and that the holes are round, and that this assists in the connection therebetween.

The connecting strips 3 are slightly stretched when the fastener 1 is fitted to the shoe 2. The connecting strips 3 are in tension and therefore tend to urge the two-part clip 6 apart when the shoe 2 is worn, thus ensuring that the clip 6 remains together during wearing of the shoe 2. If the elastic strips 3 were not in tension, the clip 6 could disengage thus the fastener 1 could become unfastened.

A further embodiment now will be described with reference to FIGS. 5 to 11.

Figure 5:
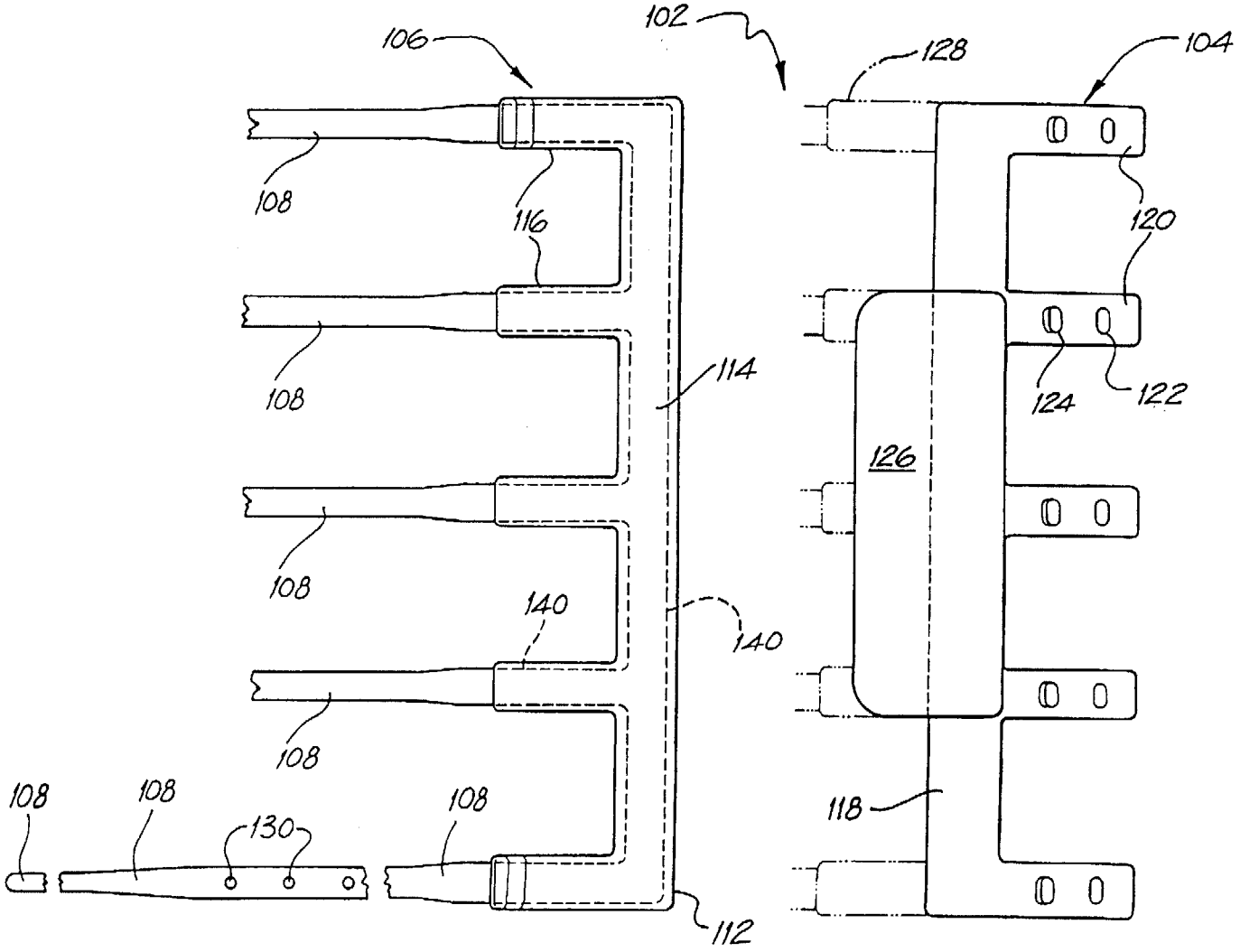
FIG. 5 is a plan view of the first and second parts of a two-part clip embodying features of the invention, the clip being shown in its disengaged configuration.

FIG. 5 shows a two-part clip 102 comprising a first part 104 and a second part 106, for fastening a shoe. The second part 106 comprises five elongate elastic connecting strips 108, which are indicated schematically in FIG. 5. Although the five connecting strips 108 are all identical with each other, only one of the connecting strips 108, namely the lowermost connecting strip 108 shown in FIG. 5, is shown in full, and this connecting strip 108 is shown with two breaks 110, indicating that the connecting strip 108 is longer than illustrated in FIG. 5. The connecting strips 108 are integrally moulded with a rigid body part 112 of the second part 106 of the clip 2. The body part 112 comprises an elongate spine portion 114 having five rib portions 116 extending perpendicularly therefrom. Each rib portion 116 supports a corresponding connecting strip 108.

The first part 104 of the clip 102 comprises a similar elongate spine portion 118, integrally formed with five similar rib portions 120. Each rib portion 120 defines two slots 122 and 124. The first part 104 is also provided with an integral release member 126, which will be described in greater detail below.

In use, the two spine portions 114 and 118 are positioned generally along the opening of a shoe (not shown), and the connecting strips 108 are passed through respective eyelets extending along both sides of the shoe opening. The connecting strips 108 are then passed through the respective slots 122 and 124 in the first part 104, thus ensuring that both parts of the two-part clip are attached to the eyelets along the sides of the shoe opening. The first and second parts 104 and 106 are then brought together, as indicated by the dotted lines 128 in FIG. 5, and interengaged in order to fasten the shoe. Small projections 130 are provided along the connecting strips 108 for engagement with the slots 122 and 124. The projections 130 allow the tension of the fastener to be adjusted to suit the comfort of the user. In other words the choice of a particular projection which engages the slots would depend upon the length of the connecting strip desired by the user, each projection adapted to act as a stop member to allow said connecting strip to be firmly secured into position at said desired length.

Figure 6B:
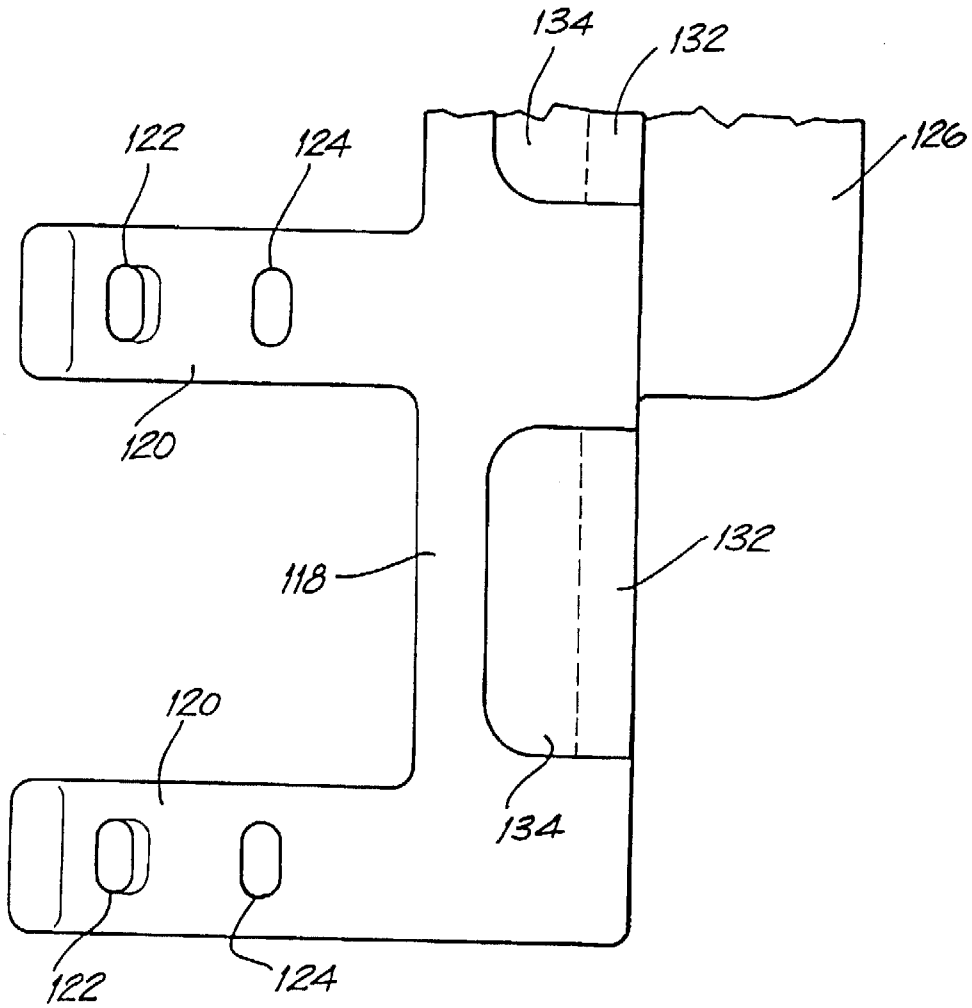
FIG. 6B is a view of the underside of the portion of the first part of the clip shown in FIG 2A.
Figure 6A:
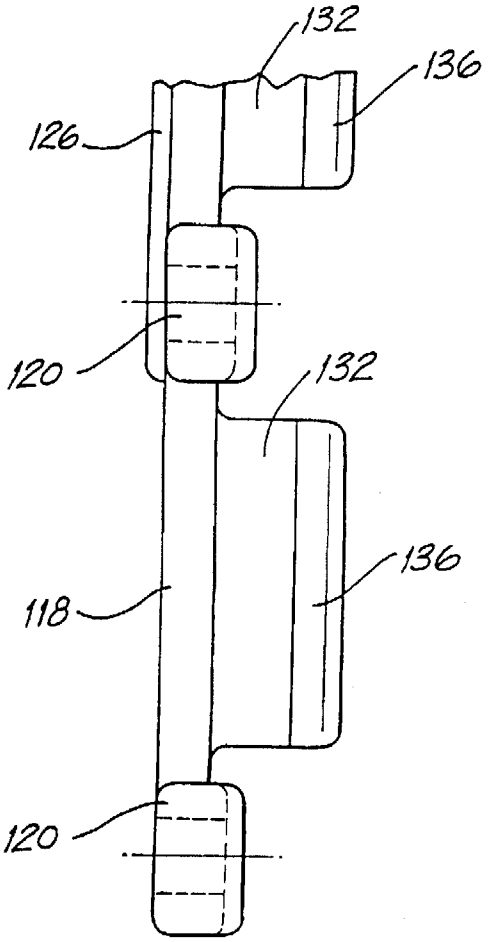
FIG 6A is a side view of a portion of the first part of the two-part clip shown in FIG. 1.

FIG. 6A shows a side view of a portion of the first part 104 of the clip 102. It can be seen from FIG. 6A that hook-like members 132 are integrally formed below the spine portion 118, and located between the rib portions 120. There are thus four hook-like members 132 in total, each comprising a downwardly projecting portion 132, and a lower laterally projecting portion 136. The same portion of the first part 104 is shown from below in FIG. 6B.

Figure 7:
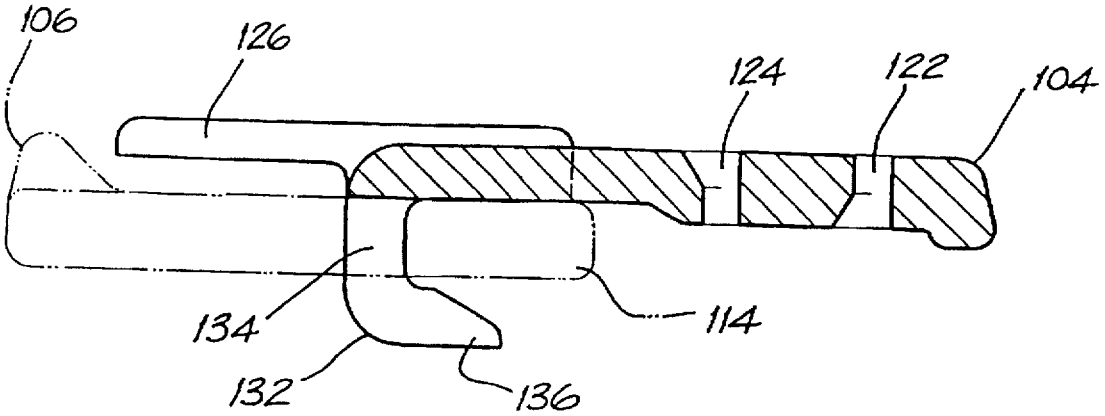
FIG. 7 is a cross-sectional view through the clip shown in FIG. 1 when the two parts of the clip are interengaged.
Figure 8:
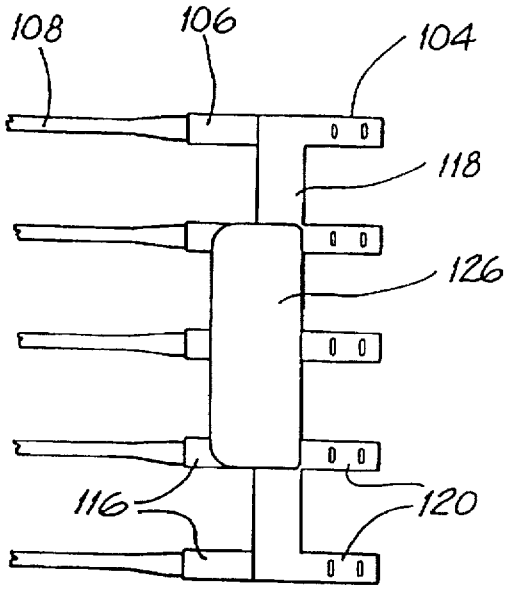
FIG. 8 is a plan view, on a reduced scale, of the two-part clip shown in FIG. 1, when the two parts of the clip are interengaged.

FIG. 7 is a cross-sectional view through the first and second parts 104 and 106 when the two parts 104 and 106 are interengaged. The interengagement is achieved by hooking the hook-like members 132 over the spine 114 of the second part 106, as shown in FIG. 7. The second part 106 is illustrated by dotted lines in FIG. 7. It will be seen that the release member 126 lies in the same general member plane as the first part 104, and projects beyond the hook-like members 132 and over the second part 106. When the user wishes to release the clip, the user simply lifts the release member 126, which causes the hook-like members 132 to become disengaged from the spine 114. It will be appreciated that the release member 126 provides the user with a mechanical advantage when releasing the clip. As can be seen from FIG. 8, the release member 126 projects just over half way along the lengths of the rib portions 116 of the second part 106.

Turning to FIGS. 9 to 11, the construction of the second part 106 is shown in greater detail. The second part 106 is formed from a two-material injection moulding process, such as that which can be carried out using equipment manufactured by Nissei Plastic Industrial Co. Ltd, of 6th Floor, KYY Building, 1-9-4 Kajicho, Chiyoda-ku, Tokyo, 101, Japan. In particular, the connecting strips 108 are formed from an elastic flexible material, such as Desmopan 385E or 192 or 786. "Desmopan" is a registered trade mark of Bayer Australia Limited (of 875 Pacific Highway, PO Box 903, Pymble, NSW 2073), and the body part 12 of the second part 6 is formed from a rigid material, such as Desmopan KA 8372 or 472.

The second part 106 is formed as a single integral piece by the injection moulding process. As indicated by the dotted lines 140 shown in FIG. 9 (and also in FIG. 5), the flexible, elastic material 142 of the connecting strips 108 extends along the entire lengths of the spine portion 114 and rib portions 116.

FIG. 10 shows the cross-sectional shape of the second part 106 at three positions, labelled A, B and C in FIG. 9, along the length of the arm shown in FIG. 9. As can be best seen from FIGS. 10 and 11, the flexible, elastic material 142 of the connecting strips 108 is contained within a lower rectangular groove 144 defined in the underside of the body part 112, which is formed from a rigid material 146.

I claim:

1. A footwear fastener for fastening an item of footwear having a plurality of eyelets arranged in spaced opposed pairs in two rows located one to either side of the shoe opening, said fastener comprising an elongate two part clip, the parts of which are releasably interengageable, said clip having a longitudinal extent substantially equal to at least a substantial portion of the length of said row, and a plurality of elongate elastic connecting strips attachable to both parts of the clip in a parallel relationship and at positions corresponding to the spacing of the eyelet pairs, and each said elongate elastic strip being adapted to pass through one of said opposed eyelet pairs so as to secure said pair of eyelets together when the two parts of the clip are interengaged.

2. The footwear fastener according to claim 1, wherein each elastic connecting strip is integrally formed at one end with one of said parts.

3. The footwear fastener according to claim 1, wherein said two part clip includes a top part and a bottom part, said top part being releasably interengageable with said bottom part.

4. The footwear fastener according to claim 3, wherein said top part includes at least one overhanging L-shaped extension(s) which is interengageable with said bottom half.

5. The footwear fastener according to claim 4, wherein said top and bottom parts include lugs extending perpendicularly therefrom, each said lug corresponding to each said eyelet and each said elongate connecting strip.

6. The footwear fastener according to claim 3, wherein said top and bottom parts include lugs extending perpendicularly therefrom, each said lug corresponding to each said eyelet and each said elongate connecting strip.

7. The footwear fastener according to claim 6, wherein said lugs are substantially in the same horizontal plane when said two part clip is engaged together.

8. The footwear fastener according to claim 7, wherein each said lug includes a pair of holes through which the end of said corresponding elongate connecting strip is able to be threaded and be retained therein.

9. The footwear fastener according to claim 8, wherein said elongate connecting strips are in the form of a flat ribbon.

10. The footwear fastener according to claim 9, wherein said flat ribbon is made from an elastomeric material.

11. The footwear fastener according to claim 1, wherein at least one of the elongate elastic connecting strips is adapted so as to adjust the length of said strip when said pair of eyelets is secured together, said at least one connecting strip being provided with a plurality of projections spaced along the length of said strip, and one of said clip parts being provided with at least one slot at a location corresponding to a position of an eyelet, said at least one connecting strip being adapted to be threaded through said at least one slot, each said projection being adapted to engage said at least one slot and to act as a stop member to allow said at least one connecting strip to the firmly secured into position at a desired length.

12. A footwear fastener for fastening an item of footwear having an opening for allowing adjustment of the footwear, and a plurality of eyelets arranged in spaced opposed pairs in two rows located on either side of the opening, the fastener comprising a two-part clip, the two parts of which are interengageable, and at least one elongate connecting strip which is integrally formed with one of said parts and adjustably attachable to the other of said parts, the connecting strip being adapted to pass through one of said opposed eyelet pairs so as to secure said pair of eyelets together when the two parts of the clip are interengaged.

13. The footwear fastener according to claim 12, wherein the connecting strip is formed of a material which is more elastic than the material of the part of the two-part clip with which it is integrally formed.

14. The footwear fastener according to claim 13, wherein the part of the two-part clip to which the connecting strip is adjustably attached comprises at least one slot adapted to receive, and adjustably secure, a portion of the connecting strip.

15. The footwear fastener according to claim 12, wherein said at least one elongate connecting strip which is integrally formed with one of said parts and adjustably attachable to the other of said parts is adapted so as to adjust the length of said strip when said pair of eyelets is secured together, said at least one connecting strip being provided with a plurality of projections spaced along the length of said strip and one of said clip parts being provided with at least one slot at a location corresponding to a position of an eyelet, said at least one connecting strip being adapted to be threaded through said at least one slot, and each said projection being adapted to engage said at least one slot and to act as a stop member to allow said at least one connecting strip to be firmly secured into position at a desired length.

16. A footwear fastener for fastening an item of footwear having an opening for allowing adjustment of the footwear, and a plurality of eyelets arranged in spaced opposed pairs in two rows located on either side of the opening, the fastener comprising a two-part clip, the two parts of which are interengageable, and a plurality of elongate connecting strips connected to the two parts of the clip in parallel relationship and at positions corresponding to the spacing of the eyelet pairs, and each one of said strips being adapted to pass through one of said opposed eyelet pairs so as to secure said pair of eyelets together when the two parts of the clip are interengaged, wherein a first of said parts is provided with at least one hook-like member adapted to hook onto the second of said parts when the first and second parts are interengaged, and the first part is also provided with a release member which projects beyond the hook-like member and which overlies at least a portion of the second part when the two parts are interengaged, and wherein the release member is arranged so that an upward pull on the release member by a user causes the hook-like member to disengage from the second part, thus allowing the first and second parts of the clip to separate.

17. The footwear fastener according to claim 16, wherein the release member lies in the same general plane as the first part of the clip.

18. The footwear fastener according to claim 16, wherein the release member can be upwardly inclined relative to the plane of the first part.

19. The footwear fastener according to claim 16, wherein at least one of the elongate elastic connecting strips is adapted so as to adjust the length of said strip when said pair of eyelets is secured together, said at least one connecting strip being provided with a plurality of projections spaced along the length of said strip, and one of said clip parts being provided with at least one slot at a location corresponding to a position of an eyelet, said at least one connecting strip being adapted to be threaded through said at least one slot, each said projection being adapted to engage said at least one slot and to act as a stop member to allow said at least one connecting strip to the firmly secured into position at a desired length.

* * * * *